US008042212B2

(12) United States Patent
Morroni et al.

(10) Patent No.: US 8,042,212 B2
(45) Date of Patent: Oct. 25, 2011

(54) MANUFACTURING SYSTEM FOR ASSEMBLED SHOE WITH SHOCK-ABSORBING INSERT IN THE HEEL

(75) Inventors: Luciano Morroni, Morrovalle (IT); Stefania Ottaviani, Morrovalle (IT)

(73) Assignee: Ottaviani S.R.L., Morrovalle (IT)

( * ) Notice: Subject to any disclaimer, the term of this patent is extended or adjusted under 35 U.S.C. 154(b) by 741 days.

(21) Appl. No.: 12/160,278

(22) PCT Filed: Jan. 15, 2007

(86) PCT No.: PCT/IT2007/000028

§ 371 (c)(1),
(2), (4) Date: Jul. 8, 2008

(87) PCT Pub. No.: WO2007/083340

PCT Pub. Date: Jul. 26, 2007

(65) Prior Publication Data

US 2009/0083914 A1 Apr. 2, 2009

(30) Foreign Application Priority Data

Jan. 20, 2006 (IT) ..... MC2006A0010

(51) Int. Cl.
*A43D 3/00* (2006.01)

(52) U.S. Cl. ..... 12/128 E; 12/133 R

(58) Field of Classification Search ..... 12/133 R, 12/135 R, 139, 133 B, 128 E, 128 R, 136 R
See application file for complete search history.

(56) References Cited

U.S. PATENT DOCUMENTS

| | | | | | |
|---|---|---|---|---|---|
| 837,913 | A | * | 12/1906 | Browne | 12/133 R |
| 976,788 | A | * | 11/1910 | Dow | 12/133 R |
| 1,778,580 | A | * | 10/1930 | Blakely | 12/133 R |
| 2,805,432 | A | * | 9/1957 | Riggs | 12/133 B |
| 3,060,470 | A | * | 10/1962 | Ponce | 12/136 R |
| 3,497,892 | A | * | 3/1970 | Parrelli | 12/133 R |
| 3,619,838 | A | * | 11/1971 | Winkler | 12/135 R |
| 3,747,146 | A | * | 7/1973 | Mayer-Rieckh | 12/142 R |
| 5,881,413 | A | * | 3/1999 | Throneburg et al. | 12/133 B |

* cited by examiner

*Primary Examiner* — Marie Patterson
(74) *Attorney, Agent, or Firm* — Egbert Law Offices PLLC

(57) ABSTRACT

The present invention relates to a manufacturing system of an assembled shoe or moccasin. The system incorporates a shock-absorbing insert inserted in a space obtained inside a false-heel. The false heal is formed by a special rigid frame that basically includes a horseshoe collar.

7 Claims, 4 Drawing Sheets

MANUFACTURING SYSTEM FOR ASSEMBLED SHOE WITH SHOCK-ABSORBING INSERT IN THE HEEL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This patent application for industrial invention relates to a manufacturing system for an assembled shoe provided with shock-absorbing insert in the heel.

The patent protection is also extended to the shoe obtained with the system according to the invention.

2. Description of Related Art Including Information Disclosed Under 37 CFR 1.97 and 37 CFR 1.98.

An assembled shoe is a shoe obtained by using a last that reproduces the shape of the foot. The upper part is put on the last and the lower ends of the upper part are rolled up, stretched and fixed under the intermediate sole that has been previously fixed on the surface of the last, with the possibility to remove it.

After the upper part is applied to the intermediate sole, the sole and the heel are applied and fixed under the intermediate sole.

The purpose of the present invention is to innovate this technique, which has been used for a very long time, in order to obtain a space on the resting area of the heel. The space is used to contain an insert made of soft, elastically deformable material, able to absorb the impact of the heel on the ground every time the foot touches the ground when walking. All sports and leisure time shoes, such as running, basketball or volleyball shoes, are normally provided with a molded bottom with elastic inserts, such as cushions made of soft rubber or rings full of air, designed to cushion the impact of the heel with the ground when running or jumping. The inserts have been exclusively used by the shoes provided with a molded bottom, in which cavities of any shape or depth can be obtained during molding to house the inserts, which are normally covered by the insole, being of a removable, washable and interchangeable type.

In the case of assembled shoes, the edges of the upper part are rolled up and fixed on the perimeter between the intermediate sole and the sole, in such a way that the insole practically covers the upper side of the intermediate sole, on which housings for the shock-absorbing inserts are impossible to obtain.

The heel is always rigid and finished with a heel layer, and therefore there is no space or way to introduce an anti-shock insert in assembled shoes. As mentioned above, the purpose of the present invention is to innovate the traditional manufacturing system of assembled shoes, in order to provide these classical shoes with the shock-absorbing inserts that have been so far exclusively used in sports shoes provided with molded bottoms.

BRIEF SUMMARY OF THE INVENTION

According to the manufacturing system of the invention, a new last is used, being characterized by a sort of heel that, once the shoe has been finished and removed from the last, creates a lowered housing inside the shoe, which is deep enough to receive a shock-absorbing insert designed to be covered and hidden under a traditional insole.

BRIEF DESCRIPTION OF THE SEVERAL VIEWS OF THE DRAWINGS

For major clarity, the description of the system of the invention continues with reference to the enclosed drawings, which only have an illustrative, not limiting sense. The sequence of operational steps is explained with diagrammatic figures that show the semi-finished product obtained from each work phase.

DETAILED DESCRIPTION OF THE INVENTION

Figure 1:
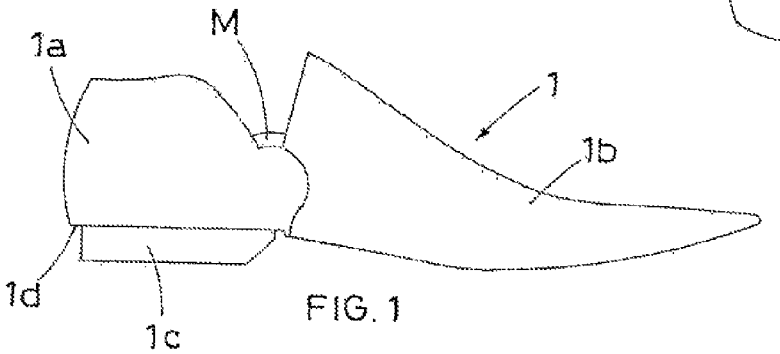
FIG. 1 is a side elevation view of the special last used for the actuation of the manufacturing system of the invention.
Figure 3:
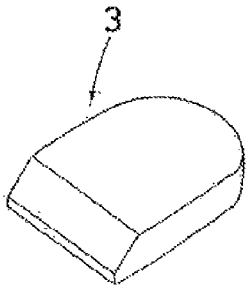
FIG. 3 is a diagrammatic schematic view of the shock-absorbing insert in the shoe obtained with the manufacturing system of the invention.
Figure 2:
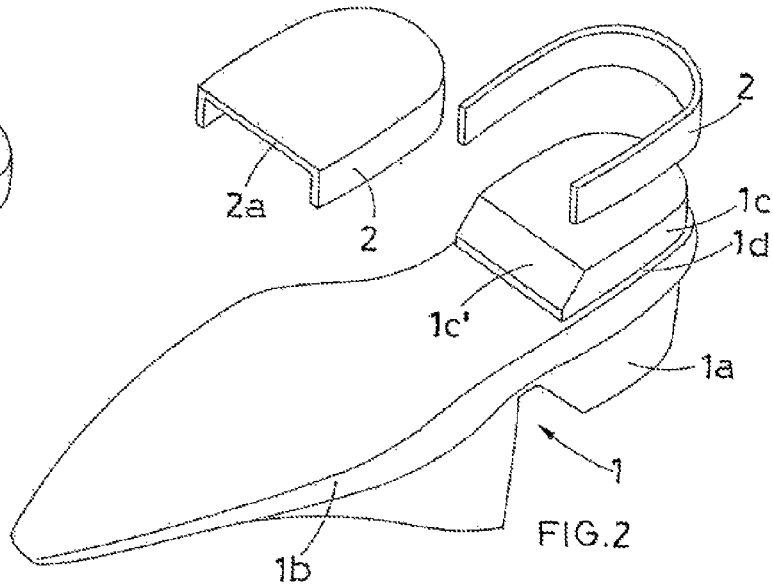
FIG. 2 is a three-quarter schematic view in a reversed position of the special last used for the actuation of the manufacturing system of the invention.

With reference to FIGS. 1 and 2, the manufacturing system of the invention uses a special last (1), of the type formed of a heel (1*a*) and a mid-sole (1*b*) connected by a spring (M). The last allows the heel (1*a*) to be lifted with respect to the mid-sole (1*b*), thus permitting removal of the shoe from the last (1) when all the work processes to be performed on the last (1) are completed.

The peculiarity of the last (1) with traditional structure is that it is provided with a heel (1*a*) that incorporates a sort of heel (1*c*) connected with the heel by means of a step (1*d*), since the heel (1*c*) is slightly smaller than the heel (1*a*).

Moreover, the manufacturing system of the invention uses a special rigid frame (2) surrounding the heel (1*c*) and consists of a horseshoe collar, preferably, but not necessarily, closed with a lower base (2*a*) used to cover the lower side of the heel (1*c*) when the frame (2) is coupled with the last.

Figure 4A:
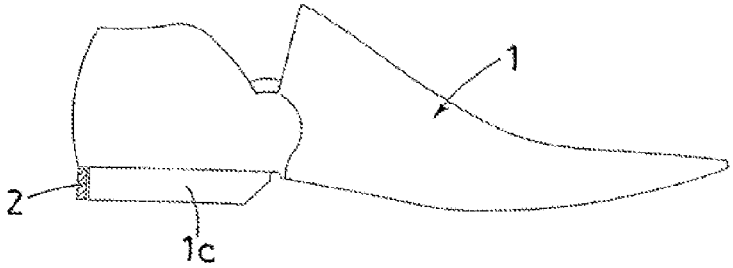
FIGS. 4A to 4F are cross-sectional views, showing a longitudinal plane of the shoe during the different manufacturing steps according to a first preferred embodiment of the system of the invention.
Figure 4B:
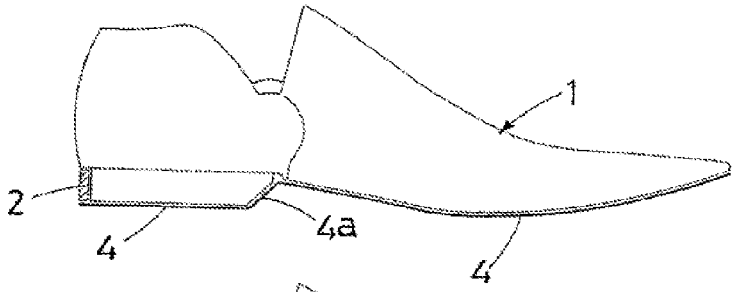
Figure 4C:
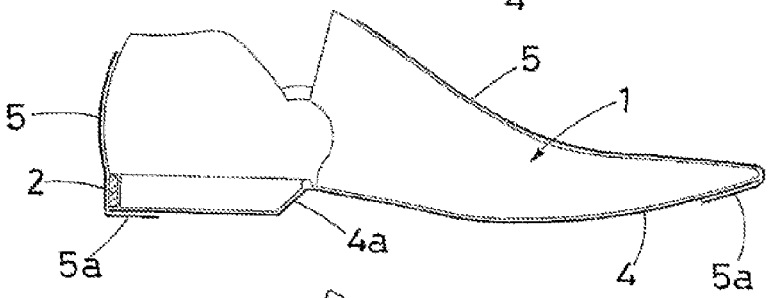
Figure 4D:
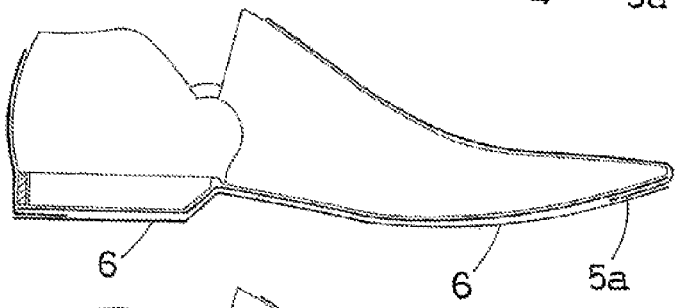
Figure 4E:
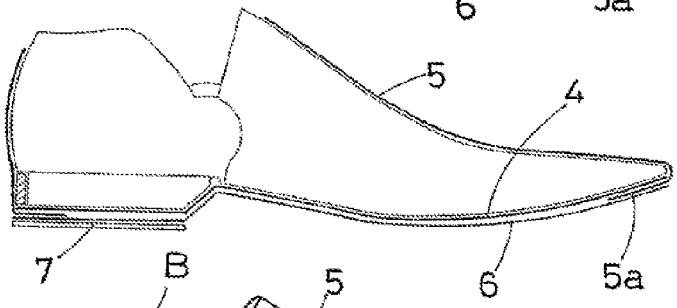
Figure 4F:
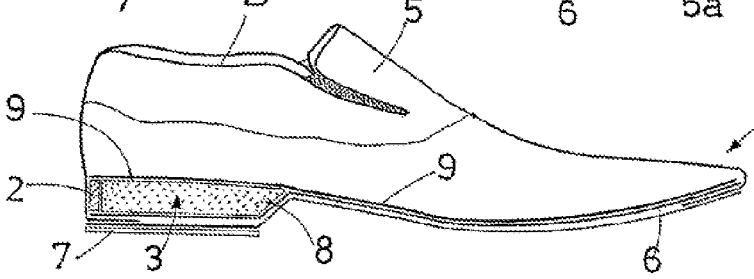

Furthermore, the manufacturing system of the invention uses a shock-absorbing insert (3) housed inside the shoe under the heel. According to a preferred embodiment, the manufacturing system of the invention includes the following sequence of work phases:

a) dovetail application of the frame (2) on the heel (1*c*) of the last (1), as shown in FIG. 4A;

b) fixing of a traditional intermediate sole (4) with known means and with possibility of removal, under the last (1), whose lower sole is completely covered from the toe to the heel by the intermediate sole (4), whose central section (4*a*) is slightly double-folded to surmount the transversal front edge (1*c*1) of the heel (1*c*), as shown in FIG. 4B;

c) fitting of the upper (5) on the last (1);

d) rolling up, stretching and fixing of the perimeter edges (5*a*) of the upper (5) by known means under the edge of the intermediate sole (4), thus hiding the horseshoe frame (2) that remains covered by the upper (5), as shown in FIG. 4C;

e) applying and fixing of a traditional sole (6) on the intermediate sole (4), as shown in FIG. 4D;

f) applying and fixing of a heel layer (7) on the sole (6) with known means, as shown in FIG. 4E;

g) removing the shoe from the last (1) and fitting of the shock-absorbing insert (3), with the same shape and size as the heel (1*c*), in such a way that it can be exactly housed in the space (8) surrounded by the horseshoe frame (2) and designed to be permanently incorporated in the finished shoe (S), hidden under a traditional insole (9) that also covers the insert (3), as shown in FIG. 4F.

Figure 5A:
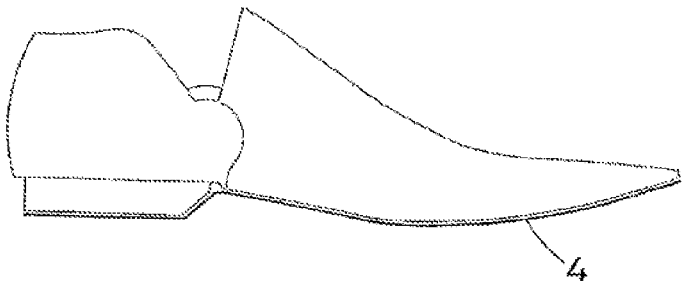
FIGS. 5A to 5F are cross-sectional views, showing a longitudinal plane of the shoe during the different manufacturing steps according to a second preferred embodiment of the system of the invention.
Figure 5B:
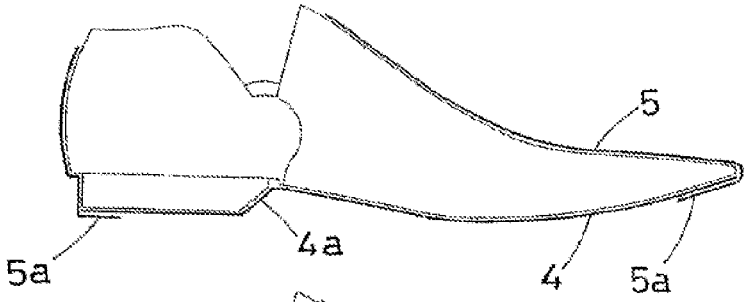
Figure 5C:
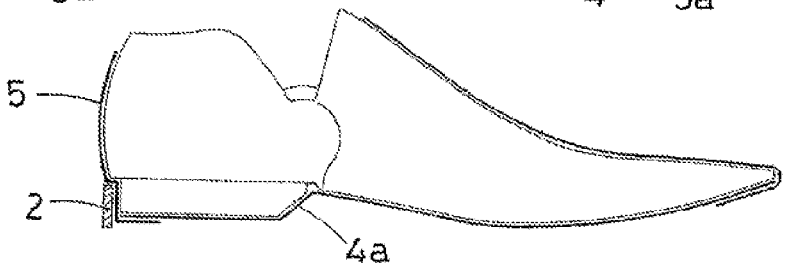
Figure 5D:
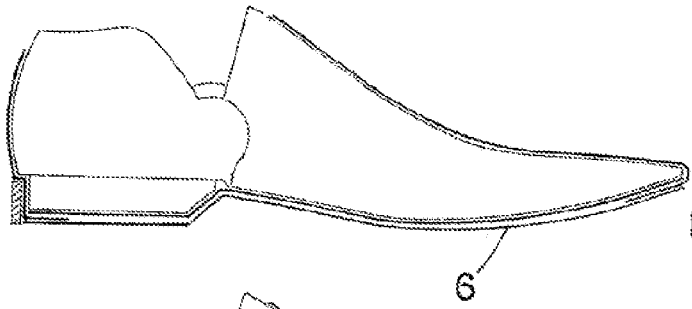
Figure 5E:
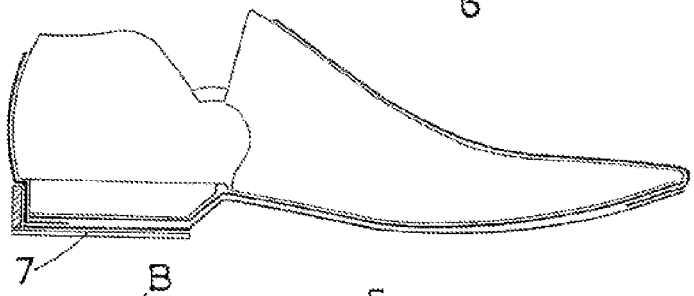
Figure 5F:
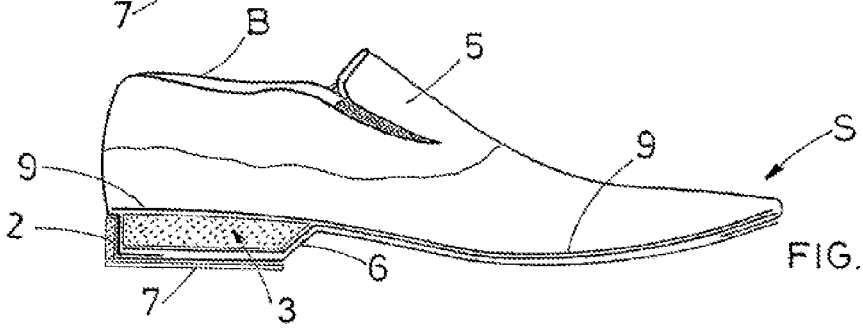

The finished shoe (S) is aesthetically characterized by the presence of a heel coated with the upper (5), which continuously extends from the opening border (B) of the shoe (B) to the false heel, being only interrupted on the heel layer (7). If the user prefers to give a traditional design to the shoe (S), with the upper (5) that leaves the heel uncovered, it would be simply necessary to postpone the first work phase described in a) as indicated below:

A) fixing of a traditional intermediate sole (4) with known means and with possibility of removal, under the last (1), whose lower sole is completely covered from the toe to the heel by the intermediate sole (4), whose central section (4*a*) is slightly double-folded to surmount the transversal front edge (1*c*1) of the heel (1*c*), as shown in FIG. 5A;

B) fitting of the upper (5) on the last (1);

C) rolling up, stretching and fixing of the perimeter edges (5*a*) of the upper (5) by known means under the edges of the intermediate sole (4), as shown in FIG. 5B;

D) dovetailing on the heel (1*c*) of the horseshoe frame (2), which covers the upper (5) in the section of upper (5) that surrounds and covers the heel (1*c*), as shown in FIG. 5C;

E) applying and fixing of a traditional sole (6) on the intermediate sole (4), as shown in FIG. 5D;

F) application and fixing of a heel layer (7) on the sole (6) with known means, as shown in FIG. 5E; and G) removing the shoe from the last (1) and fitting of the shock-absorbing insert (3), with the same shape and size as the heel (1*c*), in such a way that it can be exactly housed in the space (8) surrounded by the horseshoe frame (2) and designed to be permanently incorporated in the finished shoe (S), hidden under a traditional insole (9) that also covers the insert (3), as shown in FIG. 5F.

According to this implementation mode of the system of the invention, in which the frame (2) remains visible on the outside of the shoe (S), it is necessary to use a frame (2) with an external surface that imitates leather or multilayer leather or coated by a leather or multilayer leather strip, in such a way that the frame (2) perfectly imitates the aesthetical appearance of traditional heels.

The manufacturing system of the invention can also be used with sack uppers whose edges are folded laterally and upwards around the last (1) instead of under the last (1). This type of upper completely surrounds the sole of the last (1) and is used to produce moccasins.

Figure 7:
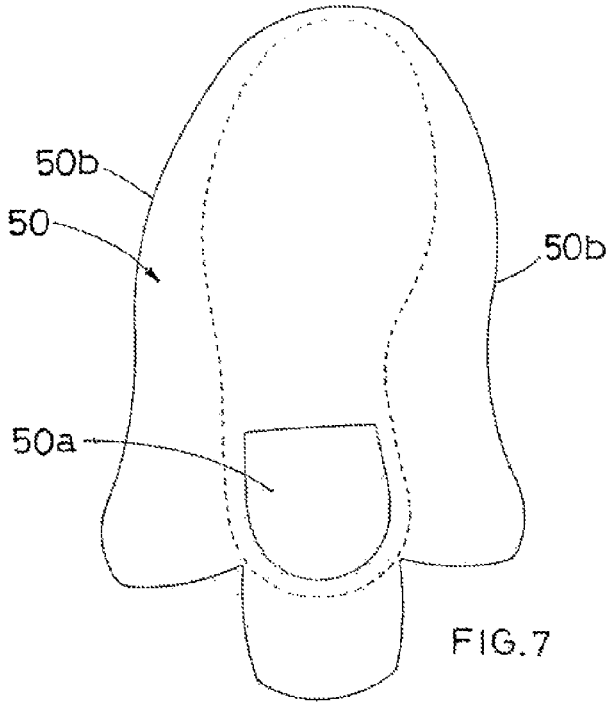
FIG. 7 is a diagrammatic schematic view of a sack style upper for the manufacturing of moccasins.

The only measure to be taken is to provide a large opening (50*a*) on the sack upper (50) under the heel of the foot, as shown in FIG. 7. When the sack upper is fitted on the last (1), the heel (1*c*) of the last (1) is inserted and protrudes from the opening.

Figure 6A:
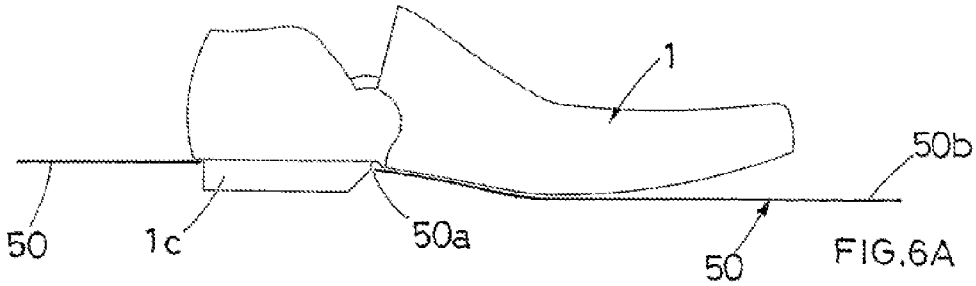
FIGS. 6A to 6F are cross-sectional views, showing a longitudinal plane of the shoe during the different manufacturing steps according to a third preferred embodiment of the system of the invention.
Figure 6B:
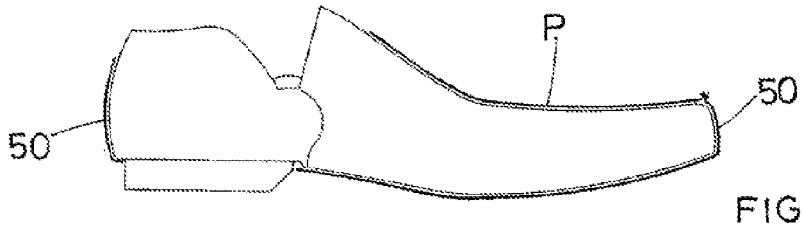
Figure 6C:
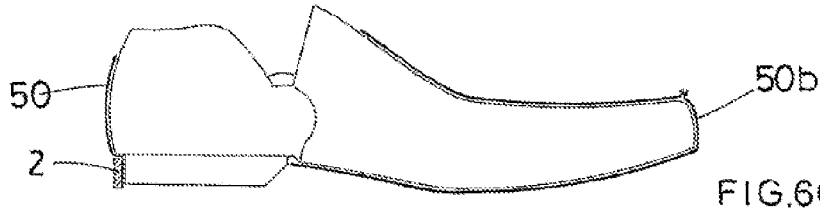
Figure 6D:
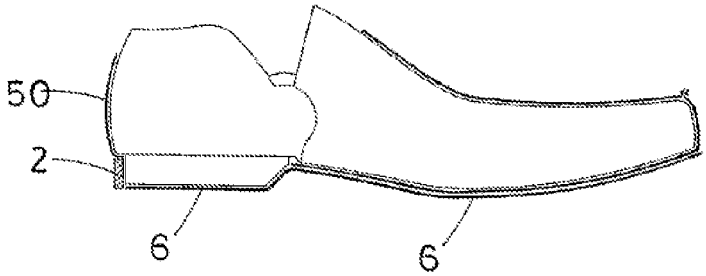
Figure 6E:
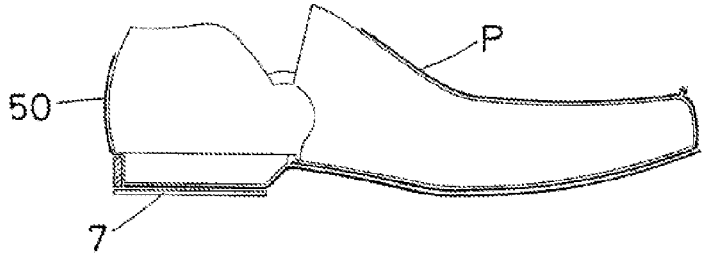
Figure 6F:
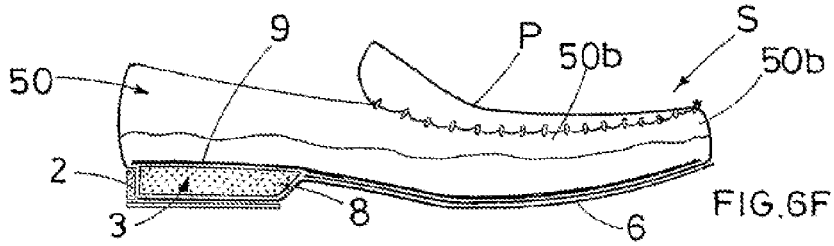

In this case, the manufacturing system of the invention includes the following sequence of work steps:

A1) inserting of the sack upper (50) on the last (1), in such a way that the heel (1*c*) is inserted and protrudes from the opening (50*a*) on the sack upper (50), as shown in FIG. 6A;

B1) rolling up, stretching and fixing of the perimeter edges (50*b*) of the upper (50) by known means on the edges of the upper flap (P) of the shoe, as shown in FIG. 6B;

C1) dovetailing application of the horseshoe frame (2) on the heel (1*c*), as shown in FIG. 6C;

D1) applying and fixing of a traditional sole (6) under the sack upper (50) with known means, as shown in FIG. 6D;

E1) applying and fixing of a heel layer (7) on the sole (6) with known means, as shown in FIG. 6E; and F1) removing the shoe from the last (1) and fitting of the shock-absorbing insert (3), with the same shape and size as the heel (1*c*), in such a way that it can be exactly housed in the space (8) surrounded by the horseshoe frame (2) and designed to be permanently incorporated in the finished shoe (S), hidden under a traditional insole (9) that also covers the insert (3), as shown in FIG. 6F. In this case the insert (3) is housed inside the space (8) thanks to the presence of a suitable opening (50*b*) on the sack upper (50).

We claim:

1. Manufacturing system for a shoe with shock-absorbing insert in the heel, said manufacturing system comprising:

a last having a heel and a mid-sole connected by a spring, said heel incorporating a heel portion connected to said heel by a step, said heel portion being smaller than said heel;

a rigid frame surrounding said heel portion and being comprised of a horseshoe collar; and a shock-absorbing insert housed inside the shoe under said heel.

2. A method of manufacturing the shoe system with shock-absorbing insert in the heel according to claim 1, said method comprising the steps of:

A) fixing of a traditional intermediate sole with known means for fixing and with possibility of removal, under the last, the intermediate sole having a lower sole completely covered from toe to heel by the intermediate sole and a central section double-folded to surmount a transversal front edge of the heel portion;

B) fitting of an upper sole on the last;

C) rolling up, stretching and fixing of perimeter edges of the upper sole by known means for fixing under edges of the intermediate sole;

D) using dovetail application on the heel portion of the horseshoe frame, covering the upper sole in a section of the upper sole surrounding and covering the heel portion;

E) applying and fixing of a traditional sole on the intermediate sole by a known means for fixing;

F) applying and fixing of a heel layer on the traditional sole with known means for fixing; and G) removing the shoe from the last and fitting of the shock-absorbing insert, having a same shape and size as the heel portion and exactly housed in the space surrounded by the horseshoe frame; and H) fitting of an insole inside the shoe hiding the insert.

3. The manufacturing system for a shoe with shock-absorbing insert in the heel, according to claim 1, said manufacturing system further comprising:

a sack upper provided with an opening in the area below the heel.

4. System as claimed in claim 1, wherein the horseshoe frame is closed with a lower base used to cover the lower side of the heel portion when the frame is coupled with the last.

5. System as claimed in claim 1, wherein the horseshoe frame has an external surface finish that imitates leather or multilayer leather or is coated with a leather or multilayer leather strip.

6. A method of manufacturing a shoe system with shock-absorbing insert in the heel, according to claim 1, said method comprising the steps of:

a) using dovetail application of the frame on the heel portion of the last;

b) fixing of a traditional intermediate sole with known means for fixing and with possibility of removal, under the last, the sole having a lower sole completely covered from toe to heel by said intermediate sole and a central section double-folded to surmount a transversal front edge of the heel portion;

c) fitting of an upper sole of the intermediate sole on the last;

d) rolling up, stretching and fixing of perimeter edges of the upper sole by known means for fixing under edges of the intermediate sole, the horseshoe frame being hidden and covered by the upper sole;

e) applying and fixing of a traditional sole on the intermediate sole;

f) applying and fixing of a heel layer on the traditional sole with known means for fixing;

g) removing the shoe from the last and fitting of the shock-absorbing insert, the insert having a same shape and size as the heel portion and being exactly housed in the space surrounded by the horseshoe frame; and h) fitting of an insole inside the shoe hiding the insert.

7. A method of manufacturing a shoe system with shock-absorbing insert in the heel, according to claim 3, said method comprising the steps of:

A1) inserting of the sack upper of the last, the heel portion being inserted and protruding from an opening on the sack upper;

B1) rolling up, stretching and fixing of perimeter edges of the upper sole by known means for fixing on edges of an upper flap of the shoe;

C1) using dovetail application of the horseshoe-shaped frame on the heel portion;

D1) applying and fixing of a traditional sole under the sack upper with known means for fixing;

E1) applying and fixing of a heel layer on the traditional sole with known means for fixing;

F1) removing the shoe from the last and fitting of the shock-absorbing insert, the insert having a same shape and size as the heel portion and being exactly housed in the space surrounded by the horseshoe frame; and G1) fitting of an insole inside the shoe hiding the insert.

* * * * *